US008313101B2

(12) United States Patent
Wicki et al.

(10) Patent No.: US 8,313,101 B2
(45) Date of Patent: Nov. 20, 2012

(54) FEEDER

(75) Inventors: Herbert Wicki, Ruswil (CH); Peter Wagner, Gunzgen (CH); Christoph Sägesser, Mägenwil (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 11/878,710

(22) Filed: Jul. 26, 2007

(65) Prior Publication Data

US 2008/0023902 A1 Jan. 31, 2008

(30) Foreign Application Priority Data

Jul. 26, 2006 (EP) ..... 06405320

(51) Int. Cl.
*B65H 5/02* (2006.01)

(52) U.S. Cl. ..... 271/273

(58) Field of Classification Search ..... 271/273, 271/274; 198/782; 384/247, 256–260, 295, 384/519, 583
See application file for complete search history.

(56) References Cited

U.S. PATENT DOCUMENTS

| | | | | |
|---|---|---|---|---|
| 2,500,569 | A * | 3/1950 | Rathke | 118/249 |
| 3,163,446 | A * | 12/1964 | Muncy | 281/11 |
| 3,599,313 | A | 8/1971 | Litvin | |
| 4,405,050 | A * | 9/1983 | Fenton et al. | 209/668 |
| 4,529,188 | A * | 7/1985 | Sturnick | 271/10.12 |
| 4,660,822 | A | 4/1987 | Winkler et al. | |
| 5,396,313 | A * | 3/1995 | Zoltner et al. | 399/23 |
| 5,421,569 | A * | 6/1995 | Davidson | 271/109 |
| 5,710,961 | A * | 1/1998 | Jeong | 399/256 |
| 5,784,964 | A * | 7/1998 | Rodi | 101/480 |
| 6,208,368 | B1 * | 3/2001 | Kerr | 347/242 |
| 6,332,715 | B1 * | 12/2001 | Kuzuu et al. | 384/276 |
| 6,349,819 | B1 * | 2/2002 | Nohl et al. | 198/830 |
| 6,371,283 | B1 * | 4/2002 | Manchester | 198/816 |
| 6,511,227 | B1 * | 1/2003 | Siow et al. | 384/428 |
| 6,631,608 | B1 * | 10/2003 | Eykelkamp | 56/15.6 |
| 6,955,034 | B1 * | 10/2005 | Blakeslee et al. | 56/16.4 C |
| 7,735,955 | B2 * | 6/2010 | Silverbrook et al. | 347/29 |
| 7,780,161 | B2 * | 8/2010 | Silverbrook et al. | 271/10.01 |
| 7,914,217 | B2 * | 3/2011 | Silverbrook et al. | 400/649 |
| 2004/0256338 | A1 * | 12/2004 | McGarry et al. | 211/94.01 |
| 2004/0256793 | A1 * | 12/2004 | Dettinger et al. | 271/264 |
| 2007/0286641 | A1 * | 12/2007 | Yoshida | 399/122 |

FOREIGN PATENT DOCUMENTS

| | | |
|---|---|---|
| CH | 493 337 | 3/1969 |
| CN | 1141847 A | 2/1997 |
| CN | 2260769 Y | 8/1997 |
| DE | 36 08 200 A1 | 10/1986 |

(Continued)

OTHER PUBLICATIONS

Lutke, Jost et al., "Konstruktionsmethodik, Entwicklung technischer Produkte," Jul. 2005.
Denkena, Berend et al., "Feel-Ing Schuler erleben Ingenieurwelten—Gesammelte Werke," Jul. 2005.
Ina Walzlager Schaeffel KG, "Nadellager Zylinderrollenlager," 1991.

(Continued)

*Primary Examiner* — Jeremy R Severson
(74) *Attorney, Agent, or Firm* — Venable LLP; Robert Kinbert; Ryan M. Flandro

(57) ABSTRACT

A feeder for feeding printed products includes a casing comprising a one-piece frame including two spaced apart end plates and a plurality of crosspieces connecting the two end plates. At least one shaft is arranged on the end plates. At least one positioning element is arranged on the end plates to position the shaft on the end plates.

12 Claims, 5 Drawing Sheets

FOREIGN PATENT DOCUMENTS

| | | | |
|---|---|---|---|
| DE | 43 26 387 | A1 | 2/1995 |
| EP | 0 737 571 | A1 | 10/1996 |
| EP | 1 231 176 | B1 | 2/2001 |
| EP | 1 619 151 | A2 | 1/2006 |
| JP | 61-127545 | | 6/1986 |
| JP | 2-92569 | A | 4/1990 |
| JP | 5-8898 | | 1/1993 |
| JP | 11-202731 | A | 7/1999 |
| JP | 2002-274669 | | 9/2002 |

OTHER PUBLICATIONS

EP Search Report dated Jun. 3, 2007 for EP 06405320.0.

First Office Action from the State Intellectual Property Office, P.R. China, issued on Apr. 28, 2010, in connection with counterpart Chinese Patent Application No. 200710138106.8.

Office Action issued for Japanese Application No. 2007-192708 dated Feb. 3, 2011.

* cited by examiner

FEEDER

CROSS-REFERENCE TO RELATED APPLICATION

This application claims the priority of European Patent Application No: 06405320.0, filed on Jul. 26, 2006, the subject matter of which is incorporated herein by reference in its entirety.

BACKGROUND

1. Field of Invention

The present invention relates generally printed products, and more particularly to a feeder device for positioning the printed products along a conveying path.

2. Description of the Related Art

In the printing industry, a feeder is conventionally used to pull off and convey printed products from a stack into a collector, where the printed products may be processed in various ways. For example, a feeder can be used to supply cards or merchandise samples to be glued on printed products. The feeder can also be used to supply and insert ads into newspapers and magazines. In all cases, these feeders must meet high quality standards with respect to capacity and operational safety. Also, since feeders are generally manufactured in large quantities, an easy and cost-effective large-scale production of these feeders should also be possible.

A conventional feeder of the above-described type is disclosed in Swiss Patent Application 493 337 A, wherein a gripping element is used to pull signatures from a stack and an expanding element is used to open the signatures. The signatures are then dropped onto a sword and later conveyed from the sword onto a conveying chain. The gripping element and the expanding element are arranged on shafts, which are positioned on two side plates that are joined by crosspieces.

Another conventional feeder used for supplying printed products to a conveying channel is disclosed in European Patent Application 1 231 176 B. In this feeder, a shaft is positioned on two end plates on the sides of a frame and is used for pulling printed products from a stack. The shaft includes grip disks that are fixedly mounted thereon, so as to rotate along with the shaft. The grip disks are provided with grippers, which pull respectively one printed product from the stack.

The conventional feeders described above are typically expensive to assembled and manufacture. What is needed is a feeder that can be produced and assembled at lower expense than the conventional feeders.

SUMMARY OF THE INVENTION

One embodiment of the present invention provides a feeder for feeding printed products, the feeder comprising a casing comprising a one-piece frame including two spaced apart end plates and a plurality of crosspieces connecting the two end plates; at least one shaft arranged on the end plates; and at least one positioning element arranged on at least one end plate to position the at least one shaft on the at least one end plate.

Accordingly, unlike conventional feeders, the end plates of the feeder of the invention are not screwed to the crosspieces, but are connected non-detachably to the crosspieces. According to a further embodiment, the end plates are welded to the crosspieces. Consequently, the basic frame, and thus also the casing, have fewer joining locations and are considerably more stable than a casing whose components are screwed together. According to a further embodiment, the shaft is positioned in the casing via at least one positioning element arranged on at least one of the end plates, so that the shaft can be installed and later replaced easily. The one-piece frame can be produced cost-effectively using sheet metal, plastic, or a precision casting material. The one-piece frame according to embodiments of the invention is more rigid and self-supporting than conventional frames made of thin sheet metal. The one-piece frame can also be manufactured inexpensively in large scale. Further, the installation is faster and easier since the shaft can be inserted from the outside of the end plates, which is advantages over conventional feeders in which the end plates are screwed to the crosspieces during the initial installation and thus need to be detached in order for shaft to be replaced.

According to another embodiment of the invention, at least one end plate includes a recess for inserting the shaft, wherein this recess may be a slot. The installation and replacement of the shaft is particularly easy if the slot is open along one edge of the end plate. For example, if the slot is open along a lower edge of the end plate, the shaft can be inserted from the bottom into the casing and/or the basic frame.

According to another embodiment of the invention, the positioning element includes a positioning plate attached to one of the end plates. In a further embodiment, this positioning plate also acts as a shaft bearing.

According to another embodiment of the invention, two positioning plates are attached to one of the end plates, where one of the positioning plates is used for positioning a so-called A shaft, while the other positioning plate is used for positioning a B shaft and/or a C shaft.

According to a further embodiment of the invention, one of the end plates includes a box, which may include a control unit and may be used for attaching operating elements as well as a controller.

The feeder according to the various embodiments of the invention can be manufactured cost-effectively and in large scale, while still ensuring a high operational safety. Further, according to embodiments of the invention, the components of the feeder including the shaft can also be replaced relatively easily.

BRIEF DESCRIPTION OF THE DRAWINGS

These and other features and advantages of the invention will be further understood from the following detailed description of an embodiment of the invention with reference to the accompanying drawings.

DETAILED DESCRIPTION

Figure 1:
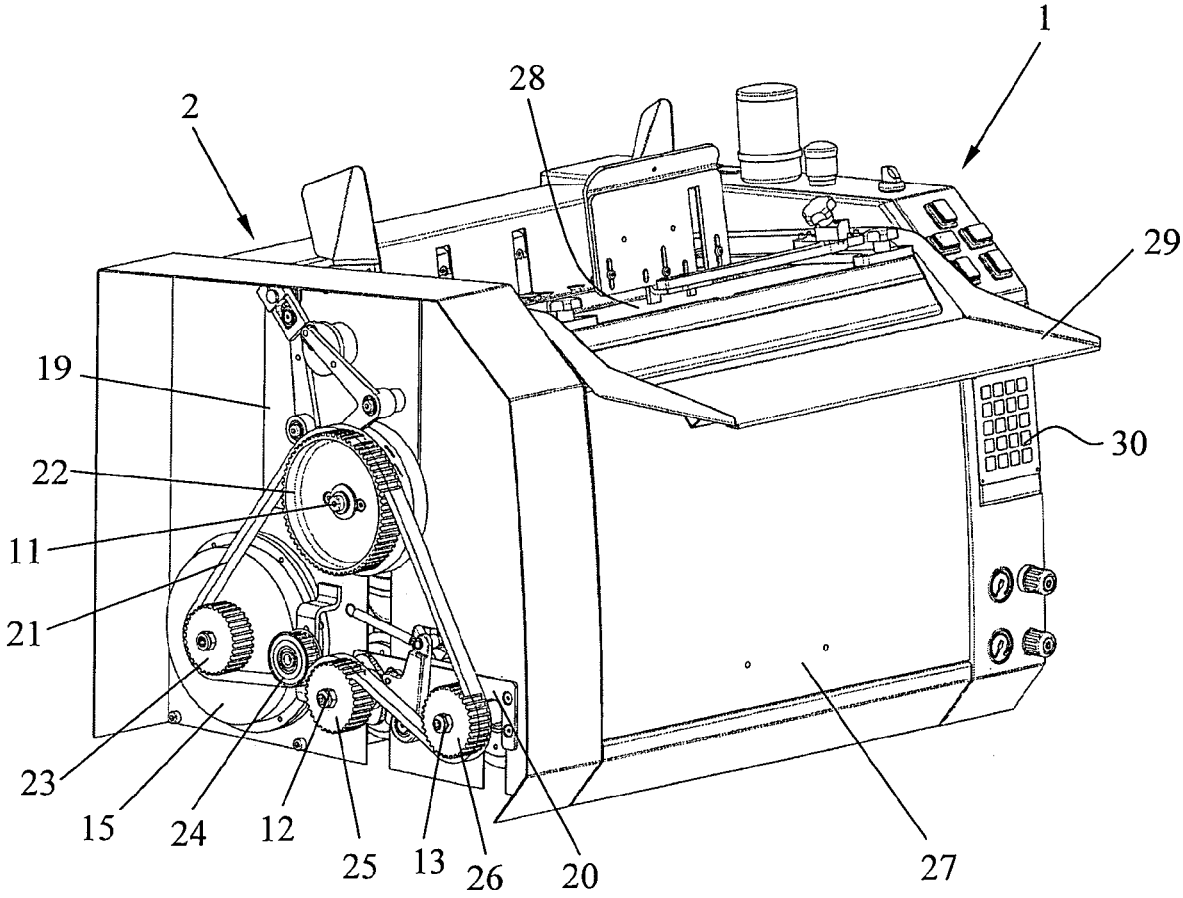
FIG. 1 depicts a three-dimensional view of a feeder according to an embodiment of the invention.

FIG. 1 depicts a feeder 1 having a casing 2 with an A shaft 11, a B shaft 12, and a C shaft 13 positioned therein, according to an embodiment of the present invention. In this embodiment, these shafts are driven by a drive 15 having a drive element 21 in the form of a toothed belt that is fitted around a toothed gear 23 and is connected to the A shaft 11, the B shaft 12, and the C shaft 13, via toothed gears 22, 25, and 26, respectively. A toothed gear 24 is positioned displaceably on a bracket 34 (shown in FIG. 3) and is used for the tensioning of the drive element 21. Also positioned inside the casing 2 are guide elements 14 and 16 for guiding the withdrawn sheets, as well as an end stop 17 and a diverter 18 (all shown in FIG. 5). The shafts 11, 12 and 13, as well as the other parts arranged and positioned inside the frame 2, are generally known in the related art and need not be explained in further detail. Depending on the type of feeder 1 that is used, the shafts 11, 12, 13 may take on different designs or, alternatively, may be omitted altogether. Embodiments of the invention utilizing only one shaft or more than three shafts are also conceivable.

Figure 3:
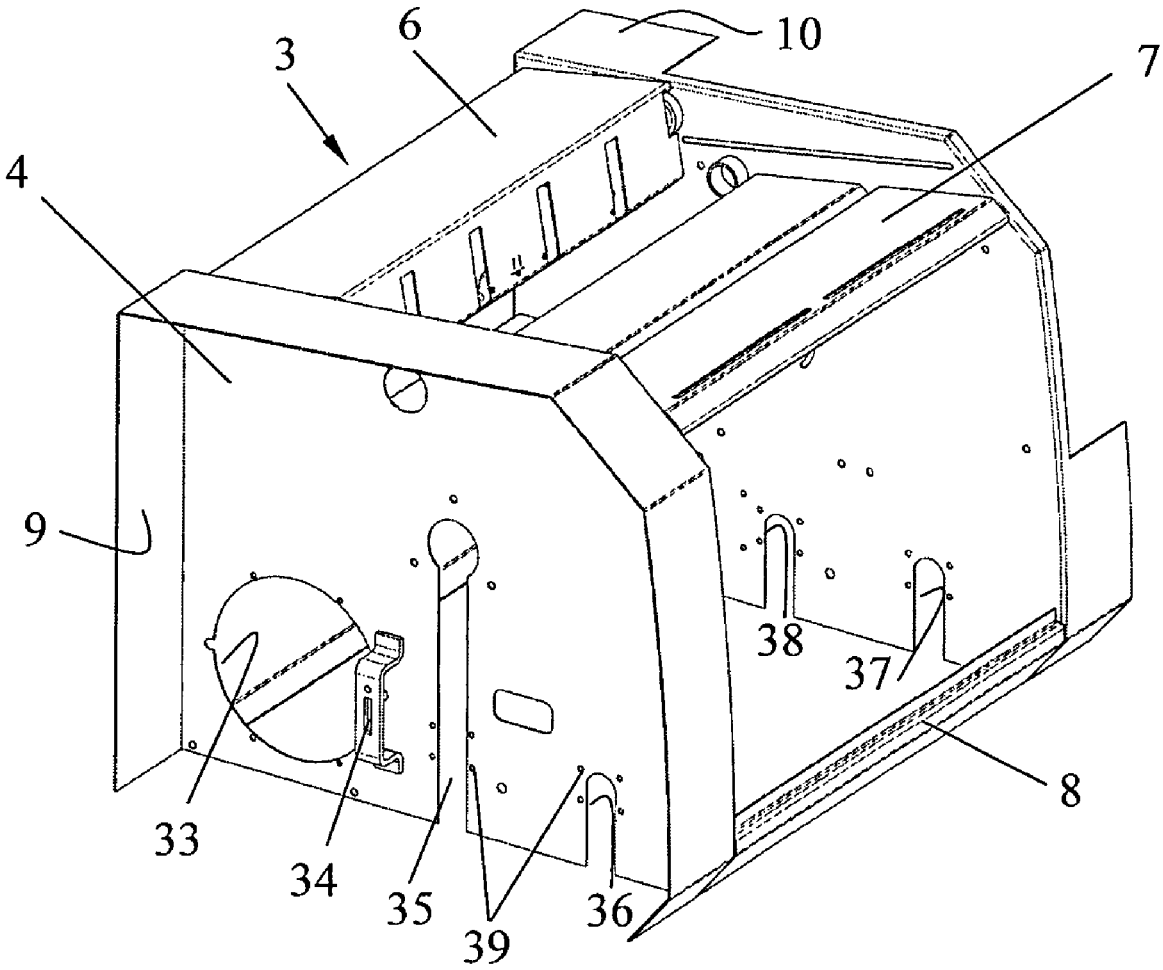
FIG. 3 depicts a three-dimensional view of the one-piece frame according to an embodiment of the invention.
Figure 4:
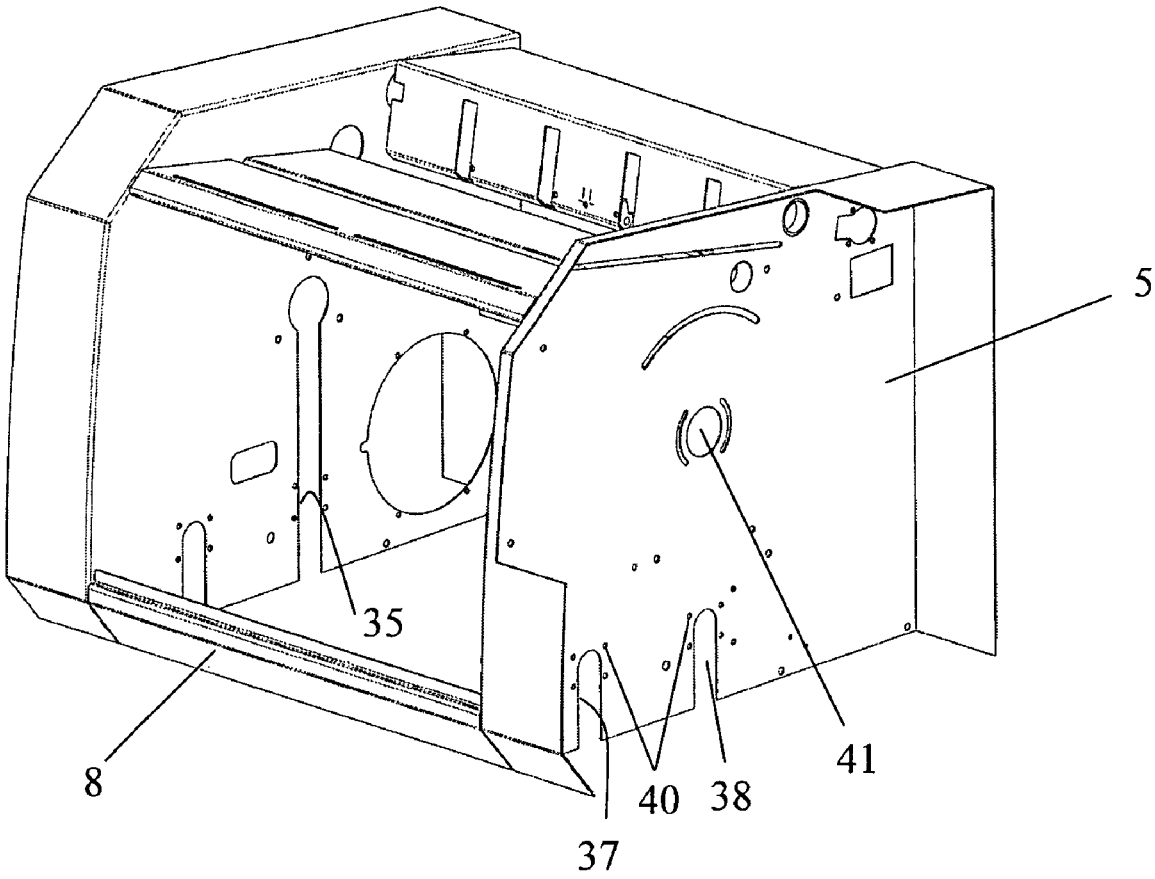
FIG. 4 depicts a different three-dimensional view of the one-piece frame from that shown in FIG. 3.

As best shown in FIGS. 3-4, the casing 2 includes a one-piece basic frame 3, provided with a first end plate 4 and a second end plate 5 on opposite sides, which are fixedly joined to one another by a first crosspiece 6, a second crosspiece 7, as well as a third crosspiece 8. According to one embodiment, the two end plates 4 and 5 are welded to the crosspieces 6, 7 and 8. However, the end plates 4 and 5 can also be joined to the crosspieces 6, 7 and 8 in a different manner, e.g., via glue. In other embodiments, it is also conceivable for the casing to be made of plastic or precision casting material. The basic frame 3 may also be produced from comparatively thin sheet metal and especially metal plate.

The separate end plates 4 and 5 on the sides are respectively reinforced by a bent section 9 and/or 10, as shown in FIG. 3. The bent section 10 on the second end plate 5 is designed to hold an attachment 42, shown in FIG. 2, which forms a box 31 together with a side flap that is not shown herein. This attachment 42 serves to accommodate an input unit 30 as well as other operating elements. A control unit 32, and other elements such as a controller, may also be installed inside the box 31. A removable front panel 27 (FIG. 1) functions to cover an opening between the crosspieces 7 and 8.

Figure 2:
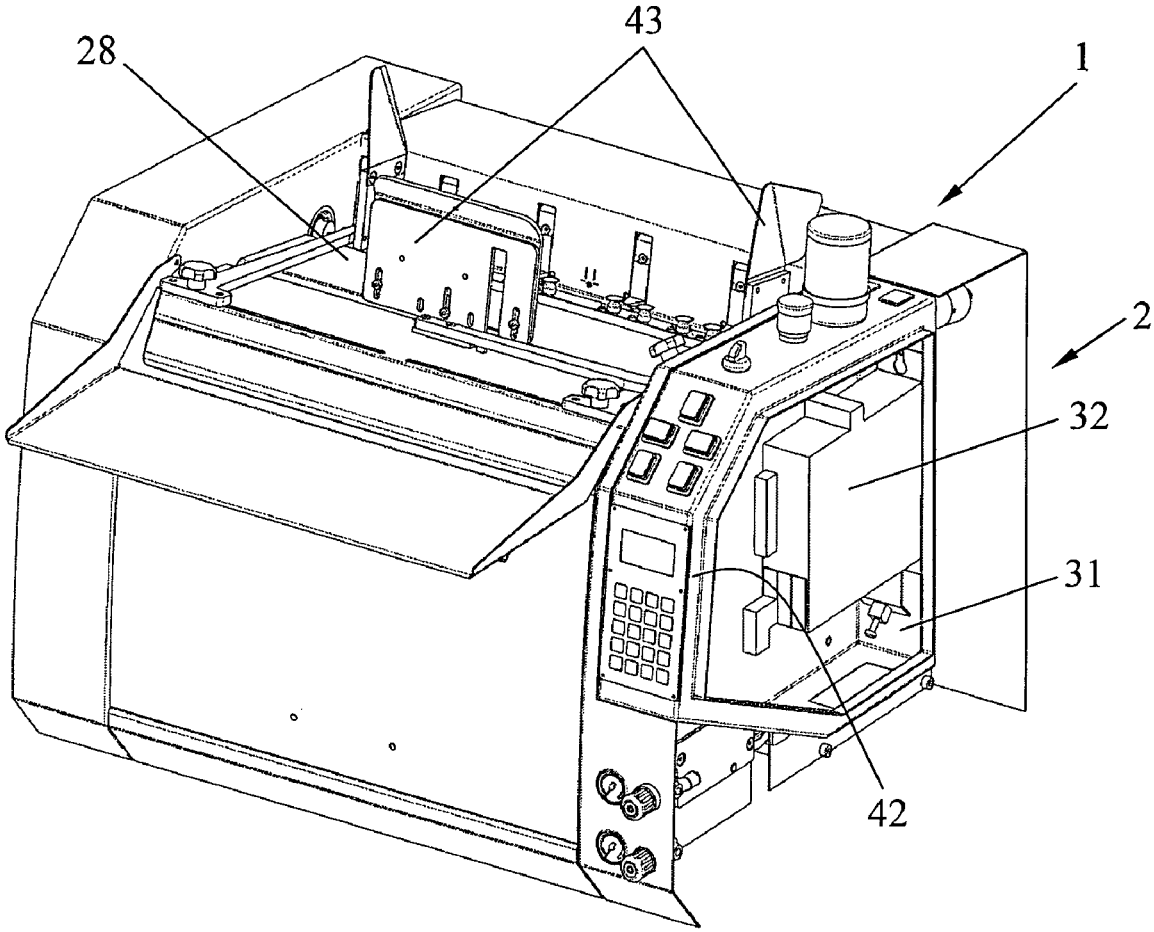
FIG. 2 depicts a different three-dimensional view of the feeder of FIG. 1.

According to an embodiment of the invention, for feeding in the printed products, which are not shown herein, the top of the casing 2 may include a stack support 28 on which adjustable end stops 43 are arranged (see FIGS. 1-2). In addition, a pivoting table 29 may also be arranged on the casing 2.

Referring now to FIG. 3, according to an embodiment, the first end plate 4 is provided with a longer slot 35 and a shorter slot 36 for the installation and replacement of shafts 11, 12 and 13. Opposite the longer slot 35 are arranged a slot 38 and a circular opening 41, which, together with the slot 35, are designed to accommodate the A shaft 11 and the B shaft 12. The shorter slot 36 and a slot 37 arranged opposite thereof serve to accommodate the C shaft 13. An upper positioning plate 19 and a lower positioning plate 20 (FIG. 1) are further attached to the first end plate 4 for positioning the shafts 11 to 13, wherein corresponding bores 39 are provided for screwing the plates 19 and 20 to the first end plate 4. Pivot bearings for these shafts 11 to 13, which are not shown herein, are provided on the second end plate 5, in the region containing the slots 37 and 38 and the recess 41. Corresponding bores 40 are again provided for attaching these parts with screws. Finally, the first end plate 4 contains a recess 33 (FIG. 3) for accommodating the drive 15.

The A shaft 11 is installed by inserting one end of the shaft 11 end (not shown herein) from the inside of the base frame 3 into the recess 41 and by inserting the other end of the shaft 11, together with the upper positioning plate 19, into the lower end of the slot 35 and pushing it upward. Once it is in a predetermined position, the plate 19 is attached to the end plate 4, for example by screwing it on, wherein the positioning plate 19 additionally functions to reinforce the end plate 4. Finally, the bearing element for the A shaft 11, which is not shown herein, is attached to the second end plate 5.

Figure 5:
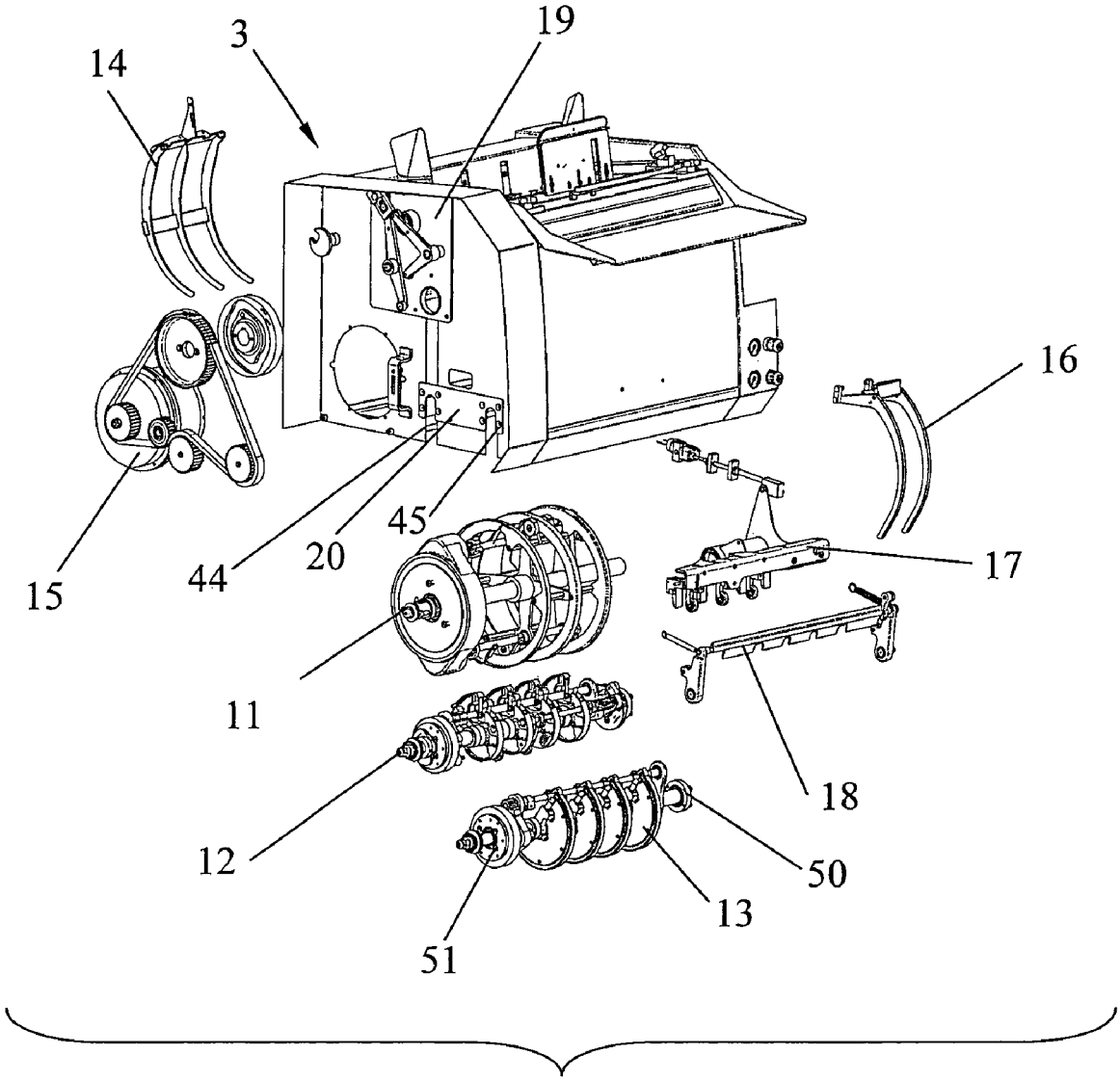
FIG. 5 depicts an exploded three-dimensional view of the feeder according to an embodiment the invention, showing individual components of the feeder separately.

The B shaft 12 is also installed from the bottom of the basic frame 3 by inserting one end of the B shaft 12 through the slot 38 and inserting the other end through the slot 35. The B shaft 12 is positioned in the first end plate 4 with the aid of the elongated lower positioning plate 20, provided with a slot 44 having an opening at the bottom, as shown in FIG. 5. The C shaft 13 is similarly installed by making use of the slots 36 and 37, as well as a slot 45 in the lower positioning plate 20. The C shaft 13 is provided with bearings 50, 51 at its opposite ends, which are attached with screws to the inside of the end plate 4. The B shaft 12 is similarly attached to the end plate 4. The B shaft 12 and the C shaft 13 can thus be dismantled easily for a replacement. For the replacement of the A shaft 11, the B shaft 12 must first be removed and then the upper positioning plate 19 detached. The shafts 11, 12 and 13 consequently can be installed and replaced without requiring changes to the basic frame 3, meaning the stability of the self-supporting basic frame 3 is maintained at all times.

It will be understood that the above description of the present invention is susceptible to various modifications, changes and adaptations, and that the same are intended to be comprehended within the meaning and range of equivalents of the appended claims.

What is claimed is:

1. A feeder for feeding printed products, comprising:

a casing comprising a one-piece frame including two spaced apart end plates and a plurality of crosspieces connecting the two end plates;

at least one shaft comprising opposite ends with bearings, the shaft being arranged on the end plates, wherein at least one of the end plates includes a slot open along a lower edge of the at least one end plate to receive the at least one shaft and a recess to accommodate a drive for rotatable driving the at least one shaft;

at least one positioning element configured to be detachably secured on at least one of the two end plates to support the at least one shaft with the bearings on the at least one end plate through the slot; and at least one attaching element configured to detachably secure the at least one positioning element to the at least one end plate.

2. The feeder according to claim 1, wherein the one-piece frame comprises one of sheet metal, plastic, or precision-cast material.

3. The feeder according to claim 1, wherein the two end plates are welded to the crosspieces.

4. The feeder according to claim 1, wherein the at least one positioning element includes a plate.

5. The feeder according to claim 1, wherein the feeder is one of a fold feeder, a feeder for a gathering or collating device, an insert feeder, a feeder for inserting merchandise samples, or a feeder for inserting labels to be glued on printed products.

6. The feeder according to claim 1, wherein the at least one positioning element is operative to fixedly arrange the at least one shaft inside the slot.

7. The feeder according to claim 1, wherein the at least one positioning element remains fixed on at least one of the two end plates after the positioning of the at least one shaft with the bearings on the at least one end plate and after the at least one attaching element detachably secures the at least one positioning element to the at least one end plate.

8. The feeder according to claim 7, wherein the at least one attached positioning element supports the at least one shaft from downward forces.

9. The feeder according to claim 1, wherein the at least one shaft comprises a plurality of shafts configured to be received in the slot.

10. The feeder according to claim 1, wherein the at least one recess comprises a plurality of recesses each comprising a slot open along a lower edge of the at least one end plate.

11. The feeder according to claim 1, wherein the at least one attaching element comprises screws.

12. A feeder for feeding printed products, comprising:

a casing comprising a one-piece frame including two spaced apart end plates and a plurality of crosspieces connecting the two end plates;

at least one shaft comprising opposite ends with bearings, the shaft being arranged on the end plates, wherein at least one of the end plates includes at least one recess configured to receive the at least one shaft, wherein the at least one recess comprises a slot open along a lower edge of the at least one end plate to receive the at least one shaft;

at least one positioning element configured to be detachably secured on at least one of the two end plates to support the at least one shaft with the bearings on the at least one end plate through the slot;

at least one attaching element configured to detachably secure the at least one positioning element to the at least one end plate; and a removable panel extending between the two spaced apart end plates and covering an opening between the crosspieces.

* * * * *